US010672317B2

(12) United States Patent
Lee et al.

(10) Patent No.: US 10,672,317 B2
(45) Date of Patent: Jun. 2, 2020

(54) DISPLAY DEVICE SUPPORTING A LOW POWER MODE AND METHOD OF OPERATING A DISPLAY DEVICE

(71) Applicant: Samsung Display Co., Ltd., Yongin-si (KR)

(72) Inventors: Yoon Young Lee, Asan-si (KR); Sungchun Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/257,050

(22) Filed: Jan. 24, 2019

(65) Prior Publication Data

US 2019/0228694 A1 Jul. 25, 2019

(30) Foreign Application Priority Data

Jan. 25, 2018 (KR) ..... 10-2018-0009422

(51) Int. Cl.
*G09G 3/20* (2006.01)

(52) U.S. Cl.
CPC ..... *G09G 3/20* (2013.01); *G09G 2310/08* (2013.01); *G09G 2330/02* (2013.01);
(Continued)

(58) Field of Classification Search
CPC ..... G06F 1/32; G06F 1/3234; G06F 3/0634; G06F 1/3287; G06F 1/3284; G06F 1/3231; G06F 1/3212; G06F 1/1694; G06F 1/3203; G06F 1/3206; G06F 1/26; G06F 1/3228; G06F 1/324; G06F 1/3278; G06F 1/3293; G06F 1/3296; G06F 1/3262; G06F 1/3265; G09G 3/20; G09G 2330/12; G09G 2330/02; G09G 2310/08; G09G 2330/028; G09G 2330/026; G09G 2330/023;
(Continued)

(56) References Cited

U.S. PATENT DOCUMENTS 8,351,813 B2 * 1/2013 Hashimoto ..... G03G 15/5004 399/88
9,058,773 B2 6/2015 Park
(Continued)

FOREIGN PATENT DOCUMENTS

KR 10-2012-0114990 10/2012

*Primary Examiner* — Duc Q Dinh
(74) *Attorney, Agent, or Firm* — H.C. Park & Associates, PLC

(57) ABSTRACT

A display device includes: a display panel; a power management circuit configured to: perform a short detection operation with a first short detection condition during a start-up operation; supply first and second power supply voltages in the normal mode; and stop supplying the first and second power supply voltages in the low power mode; and a display driver configured to provide a first image signal in the normal mode and a second image signal for in the low power mode, the display driver comprising a power block configured to supply first and second standby power supply voltages in the low power mode, wherein, in a transition frame between the low power mode and the normal mode, the display driver provides the second image signal for the standby image to the display panel, and the power management circuit performs the short detection operation with a second short detection condition.

20 Claims, 11 Drawing Sheets

(52) U.S. Cl.
CPC . *G09G 2330/023* (2013.01); *G09G 2330/026* (2013.01); *G09G 2330/028* (2013.01); *G09G 2330/12* (2013.01)

(58) Field of Classification Search
CPC ..... H04N 1/00891; H04N 1/00896; H04N 1/00904; H04N 1/00885; H04N 1/00029; H04N 1/00899; H04N 1/00901; H04N 1/6091
See application file for complete search history.

(56) References Cited

U.S. PATENT DOCUMENTS

| | | | | |
|---|---|---|---|---|
| 9,064,456 | B2 | 6/2015 | Seo et al. | |
| 2012/0050249 | A1* | 3/2012 | Jin | G09G 3/20 345/212 |
| 2016/0179179 | A1* | 6/2016 | An | G06F 1/3265 345/212 |
| 2017/0243540 | A1* | 8/2017 | Liu | G09G 3/3258 |

* cited by examiner

FIG. 7

| SDCSP | 00 | 01 | 10 | 11 |
|---|---|---|---|---|
| ISDREF | 2mA | 4mA | 6mA | 8mA |
| VSDREF | 100mV | 200mV | 300mV | 400mV |

DISPLAY DEVICE SUPPORTING A LOW POWER MODE AND METHOD OF OPERATING A DISPLAY DEVICE

CROSS-REFERENCE TO RELATED APPLICATION

This application claims priority from and the benefit of Korean Patent Application No. 10-2018-0009422, filed on Jan. 25, 2018, which is hereby incorporated by reference for all purposes as if fully set forth herein

BACKGROUND

Field

Exemplary embodiments of the present inventive concept relate to display devices, and more particularly to display devices supporting low power modes and methods of operating the display devices.

Discussion of the Background

Recently, in an electronic device, such as a smart phone, a wearable electronic device, etc., a display device is required to display a predetermined standby image even while a user does not use the electronic device. Thus, a display device supporting a low power mode, such as an always-on display (AOD) mode, has been developed which displays the standby image that includes a time image, a date image, a weather image, etc. in a standby (or sleep) state of the electronic device. However, when a mode of the display device transitions from the AOD mode to a normal mode, a temporary suspension of display of the image may occur.

The above information disclosed in this Background section is only for understanding of the background of the inventive concepts, and, therefore, it may contain information that does not constitute prior art.

SUMMARY

Devices constructed according to exemplary embodiments of the invention may include a display device capable of performing a seamless mode transition between a low power mode and a normal mode. Furthermore, the method of operating a display device according to the exemplary embodiments may be capable of performing a seamless mode transition between a low power mode and a normal mode.

According to exemplary embodiments, a display device includes: a display panel configured to display a normal image in a normal mode and a standby image in a low power mode; a power management circuit configured to: perform a short detection operation with a first short detection condition during a start-up operation that activates a first power supply voltage and a second power supply voltage at power-on of the display device; supply the first power supply voltage and the second power supply voltage to the display panel in the normal mode; and stop the supply of the first power supply voltage and the second power supply voltage in the low power mode; and a display driver configured to provide a first image signal for the normal image to the display panel in the normal mode, and to provide a second image signal for the standby image to the display panel in the low power mode, the display driver including a power block configured to supply a first standby power supply voltage and a second standby power supply voltage to the display panel in the low power mode, wherein, in a transition frame between the low power mode and the normal mode, the display driver may be configured to provide the second image signal for the standby image to the display panel, and the power management circuit may perform the short detection operation with a second short detection condition different from the first short detection condition.

The first short detection condition may refer to a condition that a panel current flowing through the display panel is greater than a first reference current, and wherein the second short detection condition may refer to a condition that the panel current is greater than a second reference current, the second reference current being greater than the first reference current.

The second reference current may be greater than the first reference current by a driving current flowing through the display panel for displaying the standby image.

The display driver may be configured to transfer a short detection condition setting pulse indicating the second short detection condition to the power management circuit to change a short detection condition of the power management circuit from the first short detection condition to the second short detection condition, in response to receiving a mode control signal to enter the low power mode, and wherein the display driver may be configured to transfer the short detection condition setting pulse indicating the first short detection condition to the power management circuit to restore the short detection condition of the power management circuit to the first short detection condition, in response to receiving a mode control signal to transition from the low power mode to the normal mode.

The short detection condition setting pulse may be transferred through a single wire between the display driver and the power management circuit.

The display panel may be configured to display the standby image based on the second image signal provided from the display driver in the transition frame from the low power mode to the normal mode.

A line through which the first power supply voltage may be supplied from the power management circuit to the display panel and a line through which the second power supply voltage may be supplied from the power management circuit to the display panel are in high impedance states in the low power mode.

A line through which the first standby power supply voltage may be supplied from the power block to the display panel and a line through which the second standby power supply voltage may be supplied from the power block to the display panel are in high impedance states in the normal mode.

The power management circuit may be configured to, during the start-up operation, activate the first power supply voltage, and then activate the second power supply voltage, wherein the power management circuit may be configured to perform the short detection operation from a starting point of the activation of the first power supply voltage to a starting point of the activation of the second power supply voltage, and wherein the power management circuit may be configured to: determine whether the first short detection condition is satisfied according to a voltage level of the second power supply voltage during the short detection operation at the power-on; and determine whether the second short detection condition is satisfied according to the voltage level of the second power supply voltage during the short detection operation in the transition frame.

The power management circuit may include: a boosting converter configured to generate the first power supply voltage; an inverting converter configured to generate the second power supply voltage; a pull-down transistor connected to a line through which the second power supply voltage is supplied from the power management circuit to the display panel; a pull-down resistor connected between the pull-down transistor and a ground voltage; a comparator configured to compare the second power supply voltage with a short detection reference voltage; and a short control block configured to shut down the power management circuit in response to an output signal of the comparator.

The pull-down transistor may be turned on to pull down the second power supply voltage in response to performing the short detection operation.

The short detection reference voltage may have a first voltage level in response to performing the short detection operation with the first short detection condition, wherein the short detection reference voltage may have a second voltage level in response to performing the short detection operation with the second short detection condition, and wherein the second voltage level may be higher than the first voltage level.

The low power mode may be an always-on display (AOD) mode.

The standby image may be an AOD image may include at least one of a time image, a date image and a weather image.

According to exemplary embodiments, method of operating a display device, the method includes: performing, by a power management circuit, a start-up operation that activates a first power supply voltage and a second power supply voltage and a short detection operation with a first short detection condition at power-on of the display device; supplying, by the power management circuit, the first power supply voltage and the second power supply voltage to a display panel in a normal mode; providing, by a display driver, a first image signal for a normal image to the display panel in the normal mode such that the display panel displays the normal image in the normal mode; supplying, by the display driver, a first standby power supply voltage and a second standby power supply voltage to the display panel in a low power mode; providing, by the display driver, a second image signal for a standby image to the display panel in the low power mode such that the display panel displays the standby image in the low power mode; providing, by the display driver, the second image signal for the standby image to the display panel in a transition frame between the low power mode and the normal mode; and performing, by the power management circuit, the start-up operation and the short detection operation with a second short detection condition, the second short detection condition being different from the first short detection condition in the transition frame.

The first short detection condition may refer to a condition that a panel current flowing through the display panel is greater than a first reference current, and wherein the second short detection condition may refer to a condition that the panel current is greater than a second reference current the second reference current being greater than the first reference current.

The second reference current may be greater than the first reference current by a driving current flowing through the display panel for displaying the standby image.

The display panel may display the standby image based on the second image signal provided from the display driver in the transition frame from the low power mode to the normal mode.

The low power mode may be an always-on display (AOD) mode.

The standby image may be an AOD image may include at least one of a time image, a date image and a weather image.

As described above, in the transition frame between the low power mode and the normal mode in the display device and the method of operating the display device according to exemplary embodiments, the display driver may provide the image signal for the standby image to the display panel, and the power management circuit may perform the short detection operation with the second short detection condition different from the first short detection condition at power-on of the display device. Accordingly, the display device may perform the seamless mode transition by continuously displaying the standby image while transitioning from the low power mode to the normal mode, and may accurately perform the short detection operation with the second short detection condition while transitioning from the low power mode to the normal mode.

Additional features of the inventive concepts will be set forth in the description which follows, and in part will be apparent from the description, or may be learned by practice of the inventive concepts.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

FIG. 7 is illustrates an example of a short detection reference current and/or a short detection reference voltage set by a short detection condition setting pulse.

DETAILED DESCRIPTION OF THE EMBODIMENTS

Figure 1A:
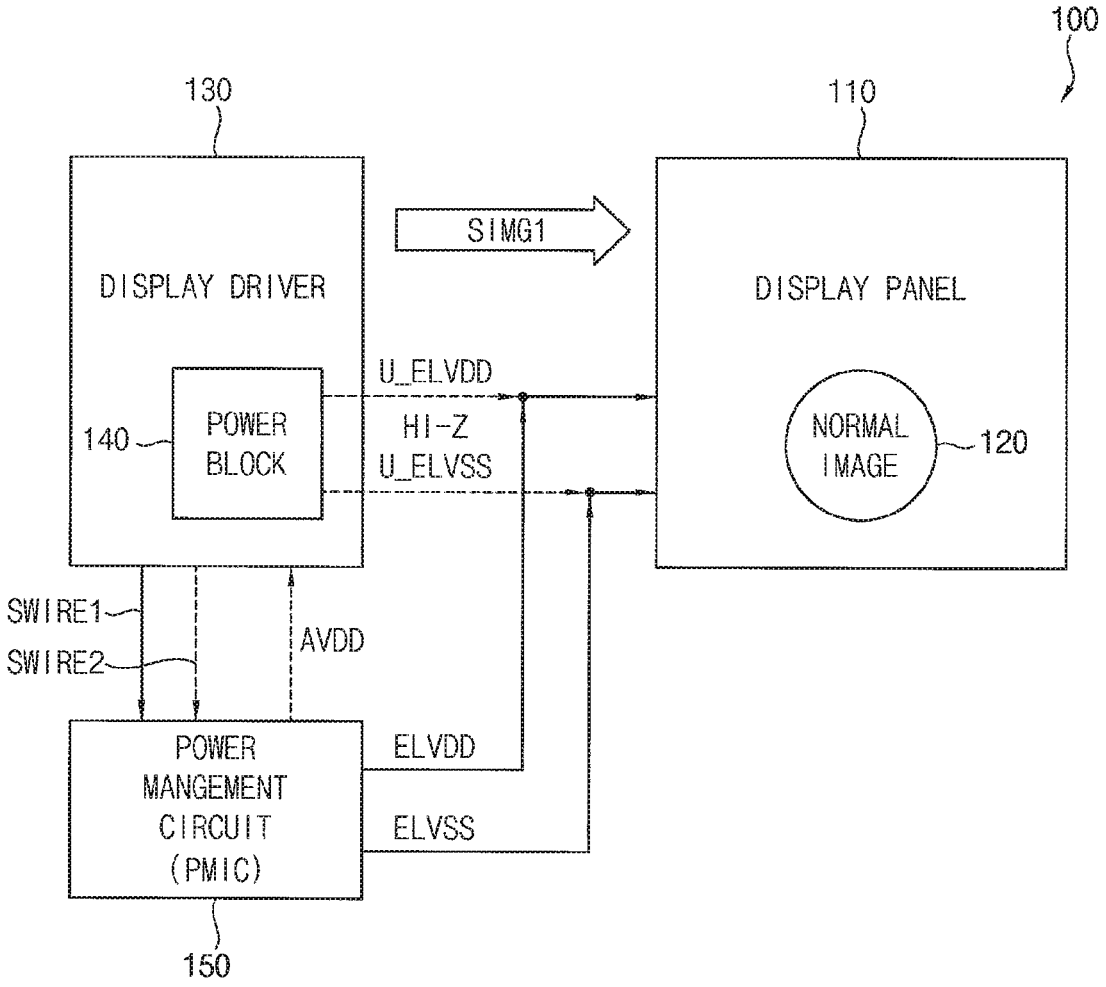
FIG. 1A is a block diagram illustrating a display device in a normal mode according to an exemplary embodiment.

In the following description, for the purposes of explanation, numerous specific details are set forth in order to provide a thorough understanding of various exemplary embodiments or implementations of implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments of the present inventive concept will be explained in detail with reference to the accompanying drawings.

Figure 1B:
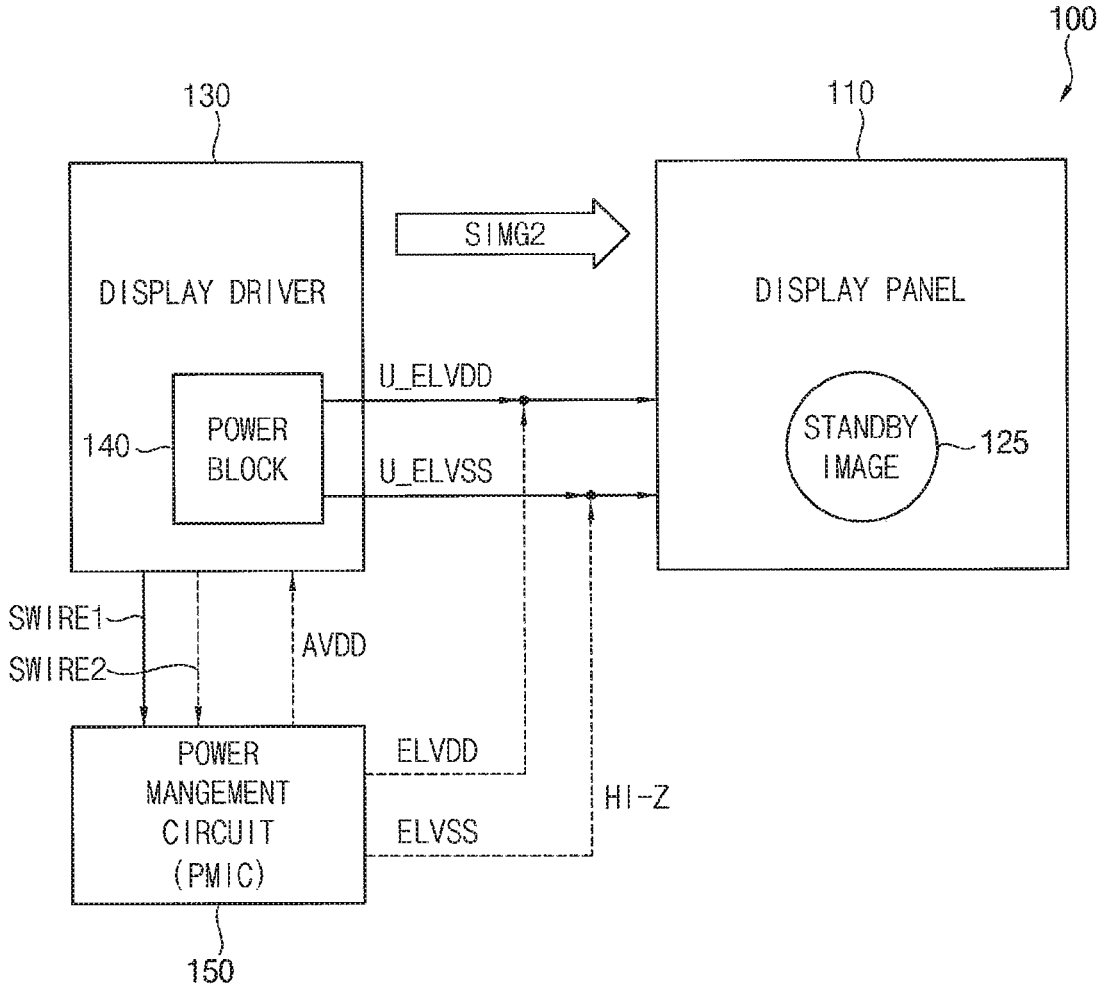
FIG. 1B is a block diagram illustrating a display device in a low power mode according to an exemplary embodiment.
Figure 2A:
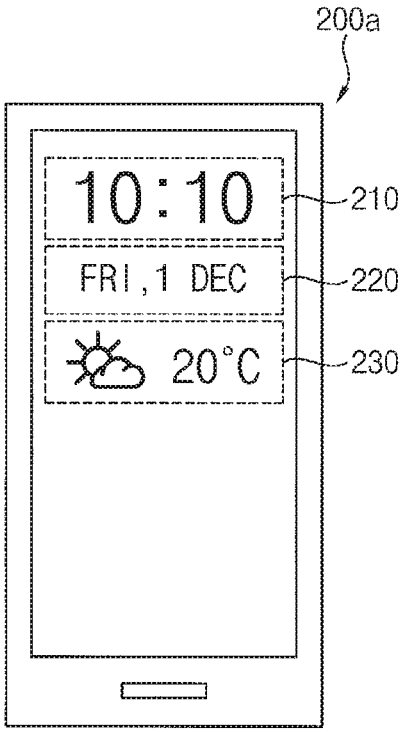
FIG. 2A illustrates an example of an electronic device including a display device that displays a standby image according to an exemplary embodiment.
Figure 2B:
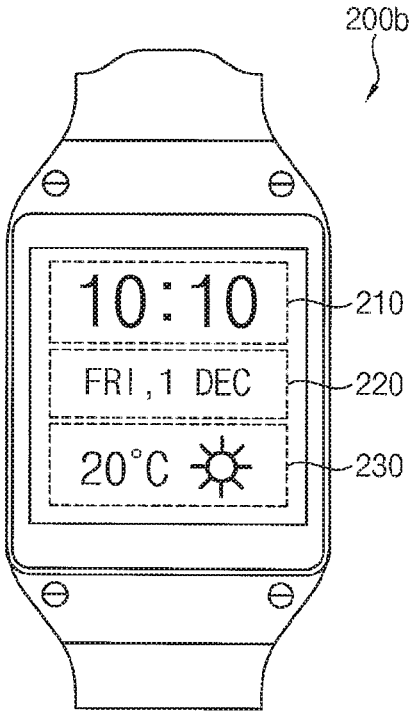
FIG. 2B illustrates another example of an electronic device including a display device that displays a standby image according to an exemplary embodiment.
Figure 3:
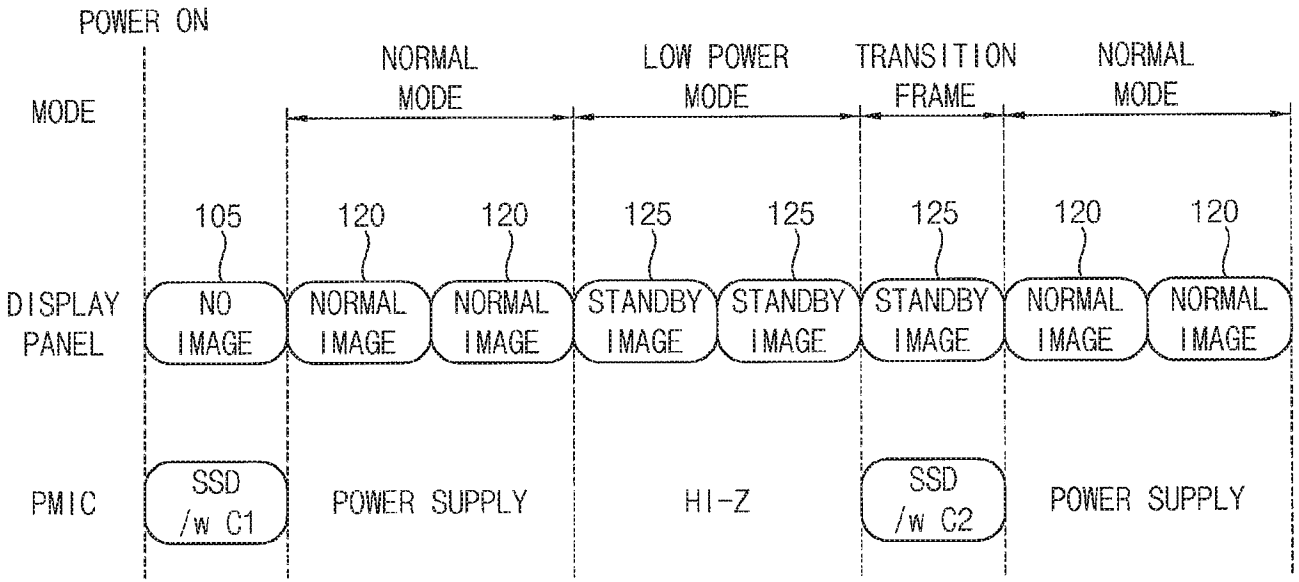
FIG. 3 is a diagram for describing an operation of a display device according to an exemplary embodiment.

FIG. 1A is a block diagram illustrating a display device in a normal mode according to an exemplary embodiment, FIG. 1B is a block diagram illustrating a display device in a low power mode according to an exemplary embodiment, FIG. 2A illustrates an example of an electronic device including a display device that displays a standby image according to an exemplary embodiment, FIG. 2B illustrates another example of an electronic device including a display device that displays a standby image according to an exemplary embodiment, and FIG. 3 is a diagram for describing an operation of a display device according to an exemplary embodiment.

Referring to FIGS. 1A and 1B, a display device 100 according to exemplary embodiments may include a display panel 110, a display driver 130 that drives the display panel 110, and a power management circuit 150 that supplies the display device 100 and the display driver 130 with power.

The display panel 110 may include a plurality of pixels arranged in a matrix form having a plurality of rows and a plurality of columns. In some exemplary embodiments, the display panel 110 may be, but not limited to, an organic light emitting diode (OLED) display panel. In other exemplary embodiments, the display panel 110 may be a liquid crystal display (LCD) panel, a plasma display panel (PDP), or the like.

The display panel 110 may display a normal image 120 in a normal mode as illustrated in FIG. 1A, and may display a standby image 125 in a low power mode as illustrated in FIG. 1B. Here, the normal image 120 may be an image displayed during a normal operation of an electronic device including the display device 100. For example, in a case where the display device 100 is included in a smart phone, the normal image 120 may be an image displayed based on image data generated by an application executed in the smart phone. The standby image 125 may be an image displayed when the electronic device including the display device 100 is in a standby (or sleep) state. In some exemplary embodiments, to reduce power consumption in the low power mode, a background of the standby image 125 may be set to a lowest gray level or a black color.

In some exemplary embodiments, the low power mode may be an always-on display (AOD) mode, and the standby image 125 may be an AOD image including at least one of a time image, a date image and a weather image. For example, as illustrated in FIG. 2A, the display device 100 according to exemplary embodiments may be included in a smart phone 200*a*, and, when the smart phone 200*a* is in the standby state, or in the AOD mode, the display device 100 may display the AOD image including the time image 210, the date image 220 and the weather image 230. In another example, as illustrated in FIG. 2B, the display device 100 according to exemplary embodiments may be included in a smart watch 200*b*, and, when the smart watch 200*b* is in the standby state, or in the AOD mode, the display device 100 may display the AOD image including the time image 210, the date image 220 and the weather image 230.

The display driver 130 may drive the display panel 110 by applying an image signal SIMG1 and SIMG2, a scan signal, etc. to the display panel 110. In some exemplary embodiments, the display driver 130 may include, but not limited to, a data driver that provides the image signal SIMG1 and SIMG2 to the display panel 110, a scan driver that provides the scan signal to the display panel 110, and a timing controller that controls operating timings of the data driver and the scan driver. In some exemplary embodiments, the display driver 130 may be implemented as a single integrated circuit. For example, the display driver 130 may be implemented as a timing controller embedded driver (TED) including the timing controller. In other exemplary embodiments, the display driver 130 may implemented with two or more integrated circuits.

The display driver 130 may provide a first image signal SIMG1 for the normal image 120 to the display panel 110 in the normal mode such that the display panel 110 displays the normal image 120 in the normal mode as illustrated in FIG. 1A, and may provide a second image signal SIMG2 for the standby image 125 (or the AOD image) to the display panel 110 in the low power mode (or the AOD mode) such that the display panel 110 displays the standby image 125 in the low power mode. For example, the display driver 130 may generate the first image signal SIMG1 based on normal image data received from an external host (e.g., a graphic processing unit (GPU)) in the normal mode, and may generate the second image signal SIMG2 based on standby image data received from the external host in the low power mode.

The display driver 130 may include a power block 140 that generates a first standby power supply voltage U_ELVDD and a second standby power supply voltage U_ELVSS. In some exemplary embodiments, the power block 140 may use a charge pump to convert a driver power supply voltage AVDD provided from the power management circuit 150 into the first standby power supply voltage U_ELVDD and the second standby power supply voltage U_ELVSS. However, a configuration and an operation of the power block 140 may not be limited to including or using the charge pump. In some exemplary embodiments, the power block 140 may not generate the first and second standby power supply voltages U_ELVDD and U_ELVSS in the normal mode, and may generate the first and second standby power supply voltages U_ELVDD and U_ELVSS to supply the first and second standby power supply voltages U_ELVDD and U_ELVSS to the display panel 110 in the low power mode. For example, lines through which the first and second standby power supply voltages U_ELVDD and U_ELVSS are supplied from the power block 140 may be in high impedance states in the normal mode as illustrated in FIG. 1A, and the first and second standby power supply voltages U_ELVDD and U_ELVSS may be provided from the power block 140 to the display panel 110 through the lines in the low power mode as illustrated in FIG. 1B.

The power management circuit 150 may generate a first power supply voltage ELVDD (e.g., a high power supply voltage) and a second power supply voltage ELVSS (e.g., a low power supply voltage) based on an external input voltage (e.g., a battery voltage). In some exemplary embodiments, the power management circuit 150 may use a boosting converter to convert the external input voltage into the first power supply voltage ELVDD, and may use an inverting converter to convert the external input voltage into the second power supply voltage ELVSS. However, a configuration and an operation of power management circuit 150 may not be limited to including or using the boosting converter and the inverting converter. In some exemplary embodiments, the power management circuit 150 may be implemented as a single integrated circuit, for example a power management integrated circuit (PMIC).

The power management circuit 150 may supply the first power supply voltage ELVDD and the second power supply voltage ELVSS to the display panel 110 in the normal mode, and may stop the supply of the first power supply voltage ELVDD and the second power supply voltage ELVSS in the low power mode. In some exemplary embodiments, the power management circuit 150 may not generate the first power supply voltage ELVDD and the second power supply voltage ELVSS in the low power mode. For example, lines through which the first and second power supply voltages ELVDD and ELVSS are supplied from the power management circuit 150 may be in high impedance states in the low power mode as illustrated in FIG. 1B, and the first and second power supply voltages ELVDD and ELVSS may be provided from the power management circuit 150 to the display panel 110 through the lines in the normal mode as illustrated in FIG. 1A.

As described above, in the low power mode, the power management circuit 150 may not generate the first and second power supply voltages ELVDD and ELVSS, and the power block 140 of the display driver 130 may supply the display panel 110 with the first and second standby power supply voltages U_ELVDD and U_ELVSS having relatively low power consumption instead of the first and second power supply voltages ELVDD and ELVSS of the power management circuit 150, which results in reduction of the power consumption in the low power mode. For example, the first and second power supply voltages ELVDD and ELVSS may be, but not limited to, about 4.6V and about −4V, respectively, and the first and second standby power supply voltages U_ELVDD and U_ELVSS may be, but not limited to, about 4.6V and about −2V, respectively.

When the display device 100 is powered on, or when the display device 100 enters the normal mode, the power management circuit 150 may perform a start-up operation that activates (or enables) the first power supply voltage ELVDD and the second power supply voltage ELVSS. Further, the power management circuit 150 may perform a short detection operation that detects a short circuit defect (e.g., a minute short circuit defect) of the display panel 110 while performing the start-up operation. In some exemplary embodiments, to perform the start-up operation, the power management circuit 150 may activate the first power supply voltage ELVDD, and then may activate the second power supply voltage ELVSS. Further, the power management circuit 150 may perform the short detection operation from a starting point of the activation of the first power supply voltage ELVDD to a starting point of the activation of the second power supply voltage ELVSS.

A conventional display device displays a black image in a transition frame from the low power mode to the normal mode. Thus, in a case the standby image 125 is displayed in the low power mode, the black image is inserted between the standby image 125 and the normal image 120, a blink of the screen may occur, and the mode transition may be perceived by a user. In the display device 100 according to exemplary embodiments, in the transition frame between the low power mode and the normal mode (e.g., in the transition frame from the low power mode to the normal mode), the display driver 130 may provide the second image signal SIMG2 for the standby image 125 to the display panel 110, and the display panel 110 may display not the black image but the standby image based on the second image signal SIMG2 provided from the display driver 130. Accordingly, in the display device 100 according to exemplary embodiments, perception of the mode transition by the user may be minimal, and a seamless mode transition may be performed.

Further, in the display device 100 according to exemplary embodiments, the power management circuit 150 may perform the short detection operation with a first short detection condition at the power-on of the display device 100, and may perform the short detection operation with a second short detection condition different from the first short detection condition. In some exemplary embodiments, the first short detection condition may refer to a condition in which a panel current flowing through the display panel 110 is greater than a first reference current, and the second short detection condition may refer to a condition in which the panel current is greater than a second reference current that is greater than the first reference current. Further, in some exemplary embodiments, the second reference current may be greater than the first reference current by a driving current flowing through the display panel 110 for displaying the standby image 125. Accordingly, since the power management circuit 150 uses the second short detection condition that is different from the first short detection condition used when the display panel 110 displays no image or the black image, the power management circuit 150 may accurately perform the short detection operation in the transition frame in which the standby image 125 different from the black image is displayed.

For example, to determine whether the first short detection condition is satisfied, i.e., to determine whether the panel current is greater than the first reference current, the power management circuit 150 may compare a voltage level of the second power supply voltage ELVSS with a first reference voltage level corresponding to the first reference current during the short detection operation at the power-on. Further, to determine whether the second short detection condition is satisfied, i.e., to determine whether the panel current is greater than the second reference current, the power management circuit 150 may compare the voltage level of the second power supply voltage ELVSS with a second reference voltage level corresponding to the second reference current during the short detection operation in the transition frame. However, the method of determining whether the first and second short detection conditions are satisfied may not be limited to using the voltage level of the second power supply voltage ELVSS.

In some exemplary embodiments, to set a short detection condition of the power management circuit 150, the display driver 130 may transfer a short detection condition setting pulse through a first single wire SWIRE1 between the display driver 130 and the power management circuit 150. For example, once the display driver 130 receives a mode control signal that requests to enter the low power mode from an external host (e.g., the GPU), the display driver 130 may transfer the short detection condition setting pulse indicating the second short detection condition to the power management circuit 150 to change the short detection condition of the power management circuit 150 from the first short detection condition to the second short detection condition. Thereafter, the power management circuit 150 may perform the short detection operation with the second short detection condition set by the short detection condition setting pulse in the transition frame from the low power mode to the normal mode. Further, once the display driver 130 receives the mode control signal that requests to transition from the low power mode to the normal mode from the external host (e.g., the GPU), the display driver 130 may transfer the short detection condition setting pulse indicating the first short detection condition to the power management circuit 150 such that the power management circuit 150 may restore the short detection condition to the first short detection condition after performing the short detection operation with the second short detection condition in the transition frame.

In some exemplary embodiments, a driver voltage setting pulse for setting a voltage level of the driver power supply voltage AVDD may be transferred from the display driver 130 to the power management circuit 150 through the first single wire SWIRE1. Further, in some exemplary embodiments, the display device 100 may further include a second single wire SWIRE2 between the display driver 130 and the power management circuit 150, and a power supply voltage setting pulse for setting a voltage level of the second power supply voltage ELVSS (and/or the first power supply voltage ELVDD) may be transferred from the display driver 130 to the power management circuit 150 through the second single wire SWIRE2.

Hereinafter, an operation of the display device 100 according to exemplary embodiments may be described below with reference to FIGS. 1A, 1B, and 3.

Referring to FIGS. 1A, 1B, and 3, once the display device 100 is powered on, the power management circuit 150 may perform the start-up operation that activates (or enables) the first power supply voltage ELVDD and that activates (or enables) the second power supply voltage ELVSS after activating the first power supply voltage ELVDD. Further, the power management circuit 150 may perform the short detection or start-up short detection (SSD) operation with the first short detection condition C1 from the starting point of the activation of the first power supply voltage ELVDD to the starting point of the activation of the second power supply voltage ELVSS. At this time, the display panel 110 may display no image or the black image.

Once the start-up operation of the power management circuit 150 is completed, the display device 100 may operate in the normal mode. In the normal mode, the power management circuit 150 supply the first power supply voltage ELVDD and the second power supply voltage ELVSS to the display panel 110, the display driver 130 may provide the first image signal SIMG1 for the normal image 120 to the display panel 110, and the display panel 110 may display the normal image 120 based on the first image signal SIMG1.

Once the display device 100 (or the display driver 130) receives the mode control signal indicating the low power mode from the external host (e.g., the GPU), the display device 100 may transition from the normal mode to the low power mode, and may operate in the low power mode. When an operating mode of the display device 100 is changed from the normal mode to the low power mode, the power management circuit 150 may not perform the start-up operation, the power block 140 may substantially immediately output the first and second standby power supply voltages U_ELVDD and U_ELVSS in response to the mode control signal, and thus a transition frame from the normal mode to the low power mode may not be inserted between the normal mode and the low power mode. In the low power mode, the power management circuit 150 may not generate the first and second power supply voltages ELVDD and ELVSS, the power block 140 may supply the first and second standby power supply voltages U_ELVDD and U_ELVSS to the display panel 110, the display driver 130 may provide the second image signal SIMG2 for the standby image 125 to the display panel 110, and the display panel 110 may display the standby image 125 based on the second image signal SIMG2. Thus, since the display panel 110 is supplied with the first and second standby power supply voltages U_ELVDD and U_ELVSS instead of the first and second power supply voltages ELVDD and ELVSS, and the background of the standby image 125 is set to the lowest gray level or the black color, the power consumption may be reduced in the low power mode.

Once the display device 100 (or the display driver 130) receives the mode control signal indicating the normal mode from the external host, the display device 100 may transition from the low power mode to the normal mode. In some exemplary embodiments, to perform the start-up operation by the power management circuit 150, at least one transition frame may be inserted when the operating mode is changed from the low power mode to the normal mode. In the transition frame, the power management circuit 150 may perform the start-up operation that activates (or enables) the first power supply voltage ELVDD and that activates (or enables) the second power supply voltage ELVSS after activating the first power supply voltage ELVDD. Further, the power management circuit 150 may perform the SSD operation with the second short detection condition C2 different from the first short detection condition C1 from the starting point of the activation of the first power supply voltage ELVDD to the starting point of the activation of the second power supply voltage ELVSS. The display driver 130 may provide the second image signal SIMG2 for the standby image 125 to the display panel 110, and the display panel 110 may display the standby image 125 based on the second image signal SIMG2. Accordingly, since the standby image 125 is displayed in the transition frame, the mode transition may not be perceived by the user, and the seamless mode transition may be performed. Further, since the SSD operation is performed with the second short detection condition C2 different from the first short detection condition C1, the SSD operation may be accurately performed.

Figure 4:
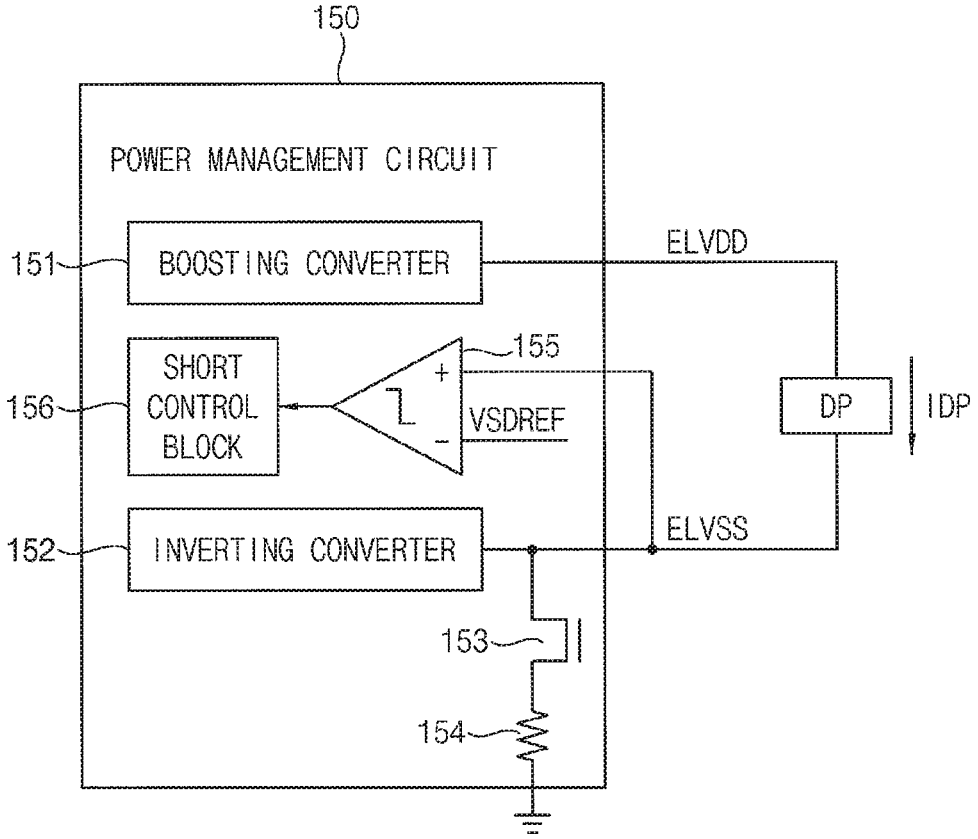
FIG. 4 is a block diagram illustrating a power management circuit included in a display device according to an exemplary embodiment.
Figure 5A:
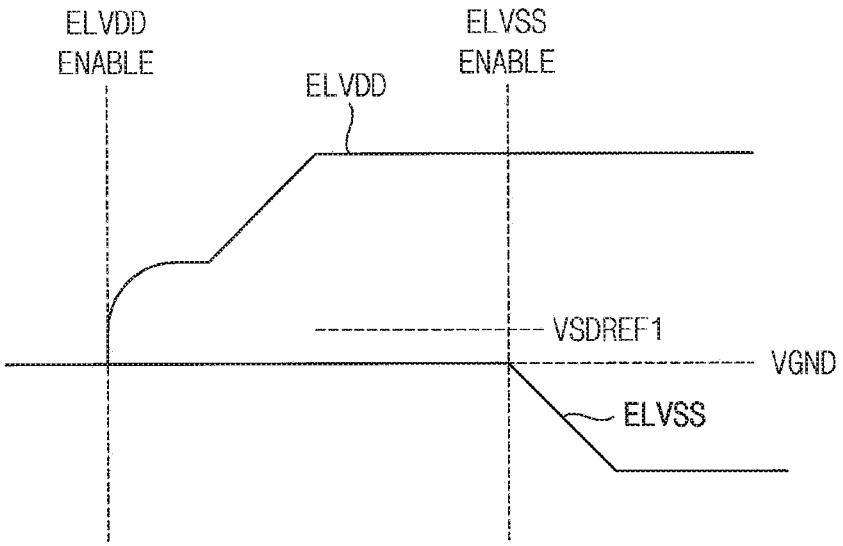
FIG. 5A is a diagram illustrating a start-up operation and a short detection operation of a power management circuit at power-on in a display device having no short circuit defect.
Figure 5B:
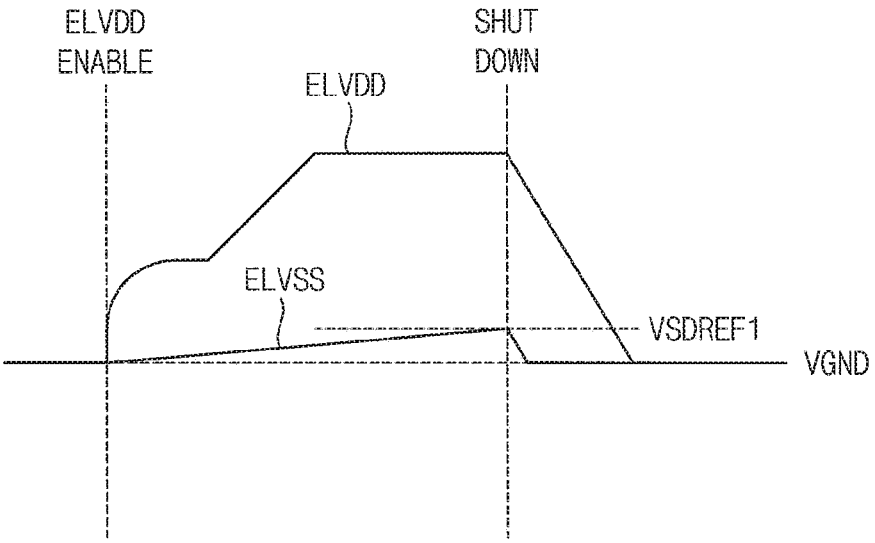
FIG. 5B is a diagram illustrating a start-up operation and a short detection operation of a power management circuit at power-on in a display device having a short circuit defect.
Figure 6A:
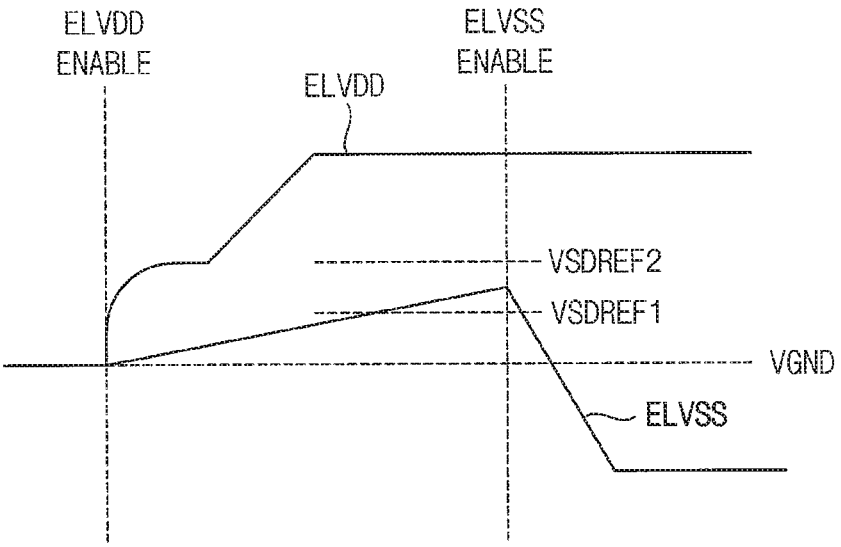
FIG. 6A is a diagram illustrating a start-up operation and a short detection operation of a power management circuit in a transition frame in a display device having no short circuit defect.
Figure 6B:
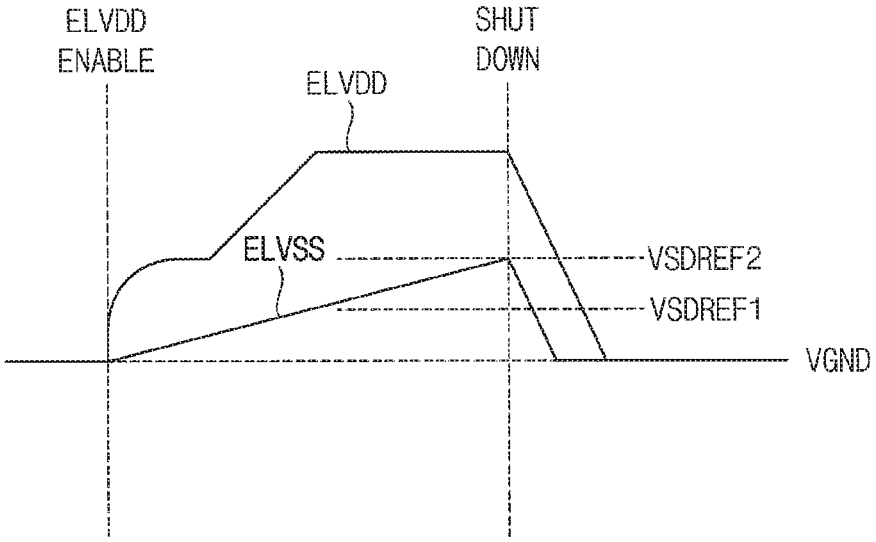
FIG. 6B is a diagram illustrating a start-up operation and a short detection operation of a power management circuit in a transition frame in a display device having a short circuit defect.

FIG. 4 is a block diagram illustrating a power management circuit included in a display device according to exemplary embodiments, FIG. 5A is a diagram illustrating a start-up operation and a short detection operation of a power management circuit at power-on in a display device having no short circuit defect, FIG. 5B is a diagram illustrating a start-up operation and a short detection operation of a power management circuit at power-on in a display device having a short circuit defect, FIG. 6A is a diagram illustrating a start-up operation and a short detection operation of a power management circuit in a transition frame in a display device having no short circuit defect, FIG. 6B is a diagram illustrating a start-up operation and a short detection operation of a power management circuit in a transition frame in a display device having a short circuit defect, and FIG. 7 is a diagram for describing an example of a short detection reference current and/or a short detection reference voltage set by a short detection condition setting pulse.

Referring to FIG. 4, a power management circuit 150 may include a boosting converter 151 that generates a first power supply voltage ELVDD, an inverting converter 152 that generates a second power supply voltage ELVSS, a pull-down transistor 153 connected to a line through which the second power supply voltage ELVSS is supplied, a pull-down resistor 154 connected between the pull-down transistor 153 and a ground voltage, a comparator 155 that compares the second power supply voltage ELVSS with a short detection reference voltage VSDREF, and a short control block 156 that shuts down the power management circuit 150 in response to an output signal of the comparator 155.

The boosting converter 151 may generate the first power supply voltage ELVDD (e.g., a high power supply voltage) by boosting an external input voltage (e.g., a battery voltage), and the inverting converter 152 may generate the second power supply voltage ELVSS (e.g., a low power supply voltage) by inverting the external input voltage (or the first power supply voltage ELVDD). The boosting converter 151 and the inverting converter 152 may supply the first power supply voltage ELVDD and the second power supply voltage ELVSS to a display panel DP in a normal mode.

When a display device is powered on, the power management circuit 150 may perform a start-up operation that sequentially activates the first power supply voltage ELVDD and the second power supply voltage ELVSS, and may perform a short detection operation with a first short detection condition from a start time point of the activation of the first power supply voltage ELVDD to a start time point of the activation of the second power supply voltage ELVSS.

In some exemplary embodiments, the first short detection condition may refer to a condition that a panel current IDP flowing through the display panel DP is greater than a first reference current. When the display device is powered on, the panel current IDP should not exist in a display panel DP without a short circuit because no image or a black image is displayed at the display panel DP. However, if a short circuit defect (e.g., a very fine short circuit defect) occur at the display panel DP, the panel current IDP may flow through the display panel DP, and the power management circuit 150 may detect the short circuit defect by detecting the panel current IDP caused by the short circuit defect.

To detect whether the panel current IDP is greater than the first reference current at the power-on, the pull-down transistor 153 may be turned on while the short detection operation is performed. While the pull-down transistor 153 is turned on, the second power supply voltage ELVSS may be pulled down through the pull-down transistor 153 and the pull-down resistor 154. While the short detection operation is performed, the second power supply voltage ELVSS that is not activated should have a voltage level substantially the same as that of the ground voltage. However, the panel current IDP caused by the short circuit defect exists, the panel current IDP may flow through the turned-on pull-down transistor 153 and the pull-down resistor 154, the second power supply voltage ELVSS may have a voltage level corresponding to a product of the panel current IDP and a resistance of the pull-down resistor 154.

The power management circuit 150 may detect whether the panel current IDP is greater than the first reference current by comparing the second power supply voltage ELVSS with the first short detection reference voltage VSDREF1 having a first voltage level corresponding to the first reference current using the comparator 155. As a result of the comparison by the comparator 155, if the second power supply voltage ELVSS is higher than the first short detection reference voltage VSDREF1, the short control block 156 may decide that the short circuit defect exits, and may shut down the power management circuit 150.

For example, once the display device is powered on, as illustrated in FIG. 5A, the power management circuit 150 may first activate the first power supply voltage ELVDD by enabling the boosting converter 151. Further, the power management circuit 150 may perform the short detection operation with the first short detection condition until the second power supply voltage ELVSS is started to be activated. In a case where the short circuit defect does not exist in the display panel DP, no panel current IDP may flow, and the second power supply voltage ELVSS may have a voltage level substantially the same as that of the ground voltage VGND. In this case, the comparator 155 may output an output signal indicating that the second power supply voltage ELVSS is lower than the first short detection reference voltage VSDREF1 having the first voltage level corresponding to the first reference current, and the short control block 156 may not shut down the power management circuit 150 in response to the output signal.

Referring to FIG. 5B, in a case where the short circuit defect exists in the display panel DP, the panel current IDP may flow through the display panel DP, and may flow also through the turned-on pull-down transistor 153 and the pull-down resistor 154. In this case, as illustrated in FIG. 5B, the voltage level of the second power supply voltage ELVSS may be increased to a voltage level corresponding to the product of the panel current IDP and the resistance of the pull-down resistor 154. Further, in a case where the panel current IDP is greater than the first reference current, the second power supply voltage ELVSS may be higher than the first short detection reference voltage VSDREF1 having the first voltage level corresponding to the first reference current. In this case, the comparator 155 may generate an output signal indicating that the second power supply voltage ELVSS is higher than the first short detection reference voltage VSDREF1 having the first voltage level, and the short control block 156 may shut down the power management circuit 150 in response to the output signal.

The power management circuit 150 may deactivate (or disable) the first power supply voltage ELVDD and the second power supply voltage ELVSS in a low power mode. Thereafter, in a transition frame from the low power mode to the normal mode, the power management circuit 150 may again perform the start-up operation that sequentially activates the first power supply voltage ELVDD and the second power supply voltage ELVSS, and may perform the short detection operation with a second short detection condition from a start time point of the activation of the first power supply voltage ELVDD to a start time point of the activation of the second power supply voltage ELVSS.

In some exemplary embodiments, the second short detection condition may refer to a condition that the panel current IDP flowing through the display panel DP is greater than a second reference current that is greater than the first reference current. In the transition frame, since a standby image is displayed at the display panel DP, a driving current for displaying the standby image may flow through the display panel DP. Accordingly, the second reference current may be greater by the driving current for displaying the standby image than the first reference current.

The pull-down transistor 153 may be turned on while the short detection operation is performed, the panel current IDP (e.g., corresponding to the driving current for displaying the standby image) may flow through the turned-on pull-down transistor 153 and the pull-down resistor 154, and the second power supply voltage ELVSS may have a voltage level corresponding to a product of the panel current IDP and the resistance of the pull-down resistor 154. The power management circuit 150 may detect whether the panel current IDP is greater than the second reference current by comparing the second power supply voltage ELVSS with the second short detection reference voltage VSDREF2 having a second voltage level corresponding to the second reference current using the comparator 155.

For example, in the transition frame, as illustrated in FIG. 6A, the power management circuit 150 may first activate the first power supply voltage ELVDD by enabling the boosting converter 151, and may perform the short detection operation with the second short detection condition until the second power supply voltage ELVSS is started to be activated. In a case where the short circuit defect does not exist in the display panel DP, the panel current IDP corresponding to the driving current for displaying the standby image may flow through the display panel DP. In this case, although the second power supply voltage ELVSS may be higher than the first short detection reference voltage VSDREF1 having the first voltage level corresponding to the first reference current, the second power supply voltage ELVSS may be lower than the second short detection reference voltage VSDREF2 having the second voltage level corresponding to the second reference current. Thus, the comparator 155 may output an output signal indicating that the second power supply voltage ELVSS is lower than the second short detection reference voltage VSDREF2 having the second voltage level corresponding to the second reference current, and the short control block 156 may not shut down the power management circuit 150 in response to the output signal.

Alternatively, in a case where the short circuit defect exists in the display panel DP, the second power supply voltage ELVSS may become higher than the second short detection reference voltage VSDREF2 having the second voltage level corresponding to the second reference current. In this case, the comparator 155 may output an output signal indicating that the second power supply voltage ELVSS is higher than the second short detection reference voltage VSDREF2 having the second voltage level, and the short control block 156 may shut down the power management circuit 150 in response to the output signal.

In some exemplary embodiments, a short detection condition of the power management circuit 150 may be set by a short detection condition setting pulse SDCSP transferred through a single wire SWIRE1 illustrated in FIG. 1. The power management circuit 150 may set a voltage level of the short detection reference voltage VSDREF to one of plurality of predetermined voltage levels in response to the short detection condition setting pulse SDCSP. For example, as illustrated in FIG. 7, the short detection condition setting pulse SDCSP may represent two bits, and the power management circuit 150 may change the voltage level of the short detection reference voltage VSDREF in response to the short detection condition setting pulse SDCSP. In an example of FIG. 7, if the short detection condition setting pulse SDCSP has a value of '00' indicating that a short detection reference current ISDREF is about 2 mA (e.g., the first reference current), the power management circuit 150 may set the voltage level of the short detection reference voltage VSDREF to about 100 mV corresponding to the short detection reference current ISDREF of about 2 mA. Further, if the short detection condition setting pulse SDCSP has a value of '11' indicating that a short detection reference current ISDREF is about 8 mA (e.g., the second reference current), the power management circuit 150 may set the voltage level of the short detection reference voltage VSDREF to about 400 mV corresponding to the short detection reference current ISDREF of about 8 mA. However, the inventive concept is not limited to the example illustrated in FIG. 7.

Figure 8:
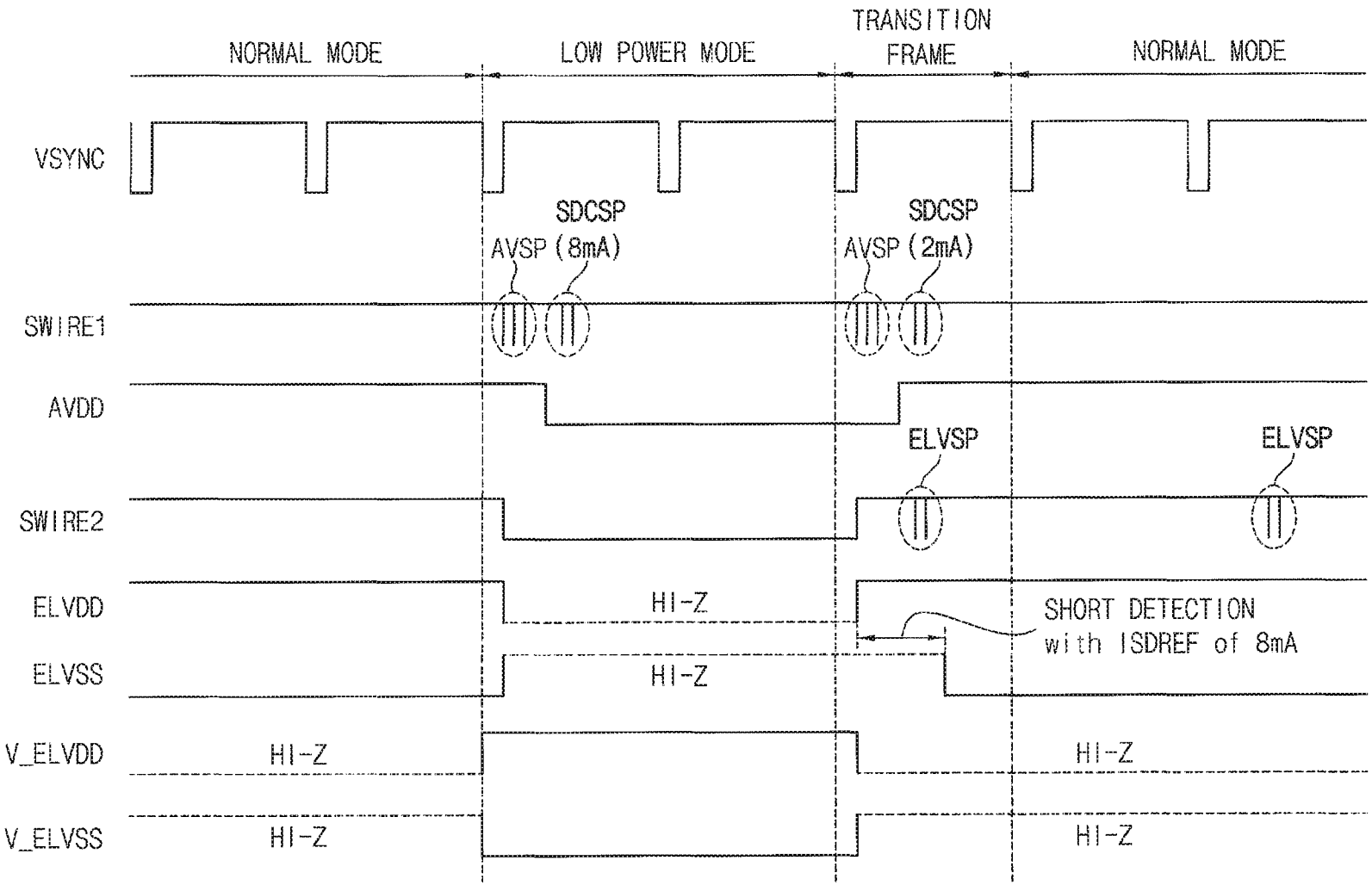
FIG. 8 is a timing diagram illustrating an operation of a display device according to an exemplary embodiment.

FIG. 8 is a timing diagram for describing an operation of a display device according to an exemplary embodiment.

Referring to FIGS. 1A, 1B, and 8, once a display device 100 enters a low power mode, a power management circuit 150 may deactivate first and second power supply voltages ELVDD and EVLSS, and lines through which the first and second power supply voltages ELVDD and EVLSS are supplied may be in high impedance (HI-Z) states. In the low power mode, instead of the first and second power supply voltages ELVDD and EVLSS of the power management circuit 150, first and second standby power supply voltages U_ELVDD and U_ELVSS of a power block 140 of a display driver 130 may be supplied to a display panel 110. The display panel 110 may display a standby image 125 in the low power mode.

In some exemplary embodiments, in the low power mode, the display driver 130 may transfer a short detection condition setting pulse SDCSP indicating a second short detection condition to the power management circuit 150 through a first single wire SWIRE1 to change a short detection condition of the power management circuit 150 from a first short detection condition (e.g., corresponding to whether a panel current is greater than a first reference current of about 2 mA) to a second short detection condition (e.g., corresponding to whether the panel current is greater than a second reference current of about 8 mA). Thus, in a transition frame from the low power mode to a normal mode, the power management circuit 150 may perform a short detection operation with the second short detection condition set by the short detection condition setting pulse SDCSP. Accordingly, in the transition frame, the display panel 110 may display the standby image 125, and the power management circuit 150 may accurately perform the short detection operation using the second short detection condition although a driving current for displaying the standby image 125 flows through the display panel 110.

Further, in the transition frame or in the subsequent normal mode, the display driver 130 may transfer the short detection condition setting pulse SDCSP indicating the first short detection condition through the first single wire SWIRE1 such that the power management circuit 150 may restore the short detection condition to the first short detection condition.

In some exemplary embodiments, in the low power mode, the display driver 130 may further transfer a driver voltage setting pulse AVSP for setting a voltage level of a driver power supply voltage AVDD to the power management circuit 150 through the first single wire SWIREL and the power management circuit 150 may decrease the voltage level of the driver power supply voltage AVDD in the low power mode in response to the driver voltage setting pulse AVSP. Further, in the transition frame, the display driver 130 may transfer the driver voltage setting pulse AVSP to restore the voltage level of the driver power supply voltage AVDD.

In some exemplary embodiments, the display driver 130 may transfer a power supply voltage setting pulse ELVSP for setting a voltage level of the second power supply voltage ELVSS to the power management circuit 150 through a second single wire SWIRE2. For example, the display driver 130 may provide power supply voltage setting pulse ELVSP to change the voltage level of the second power supply voltage ELVSS according to a temperature, a panel load, a dimming level, etc. In some exemplary embodiments, the display driver 130 may apply a low level voltage to the second single wire SWIRE2 in the low power mode.

Figure 9:
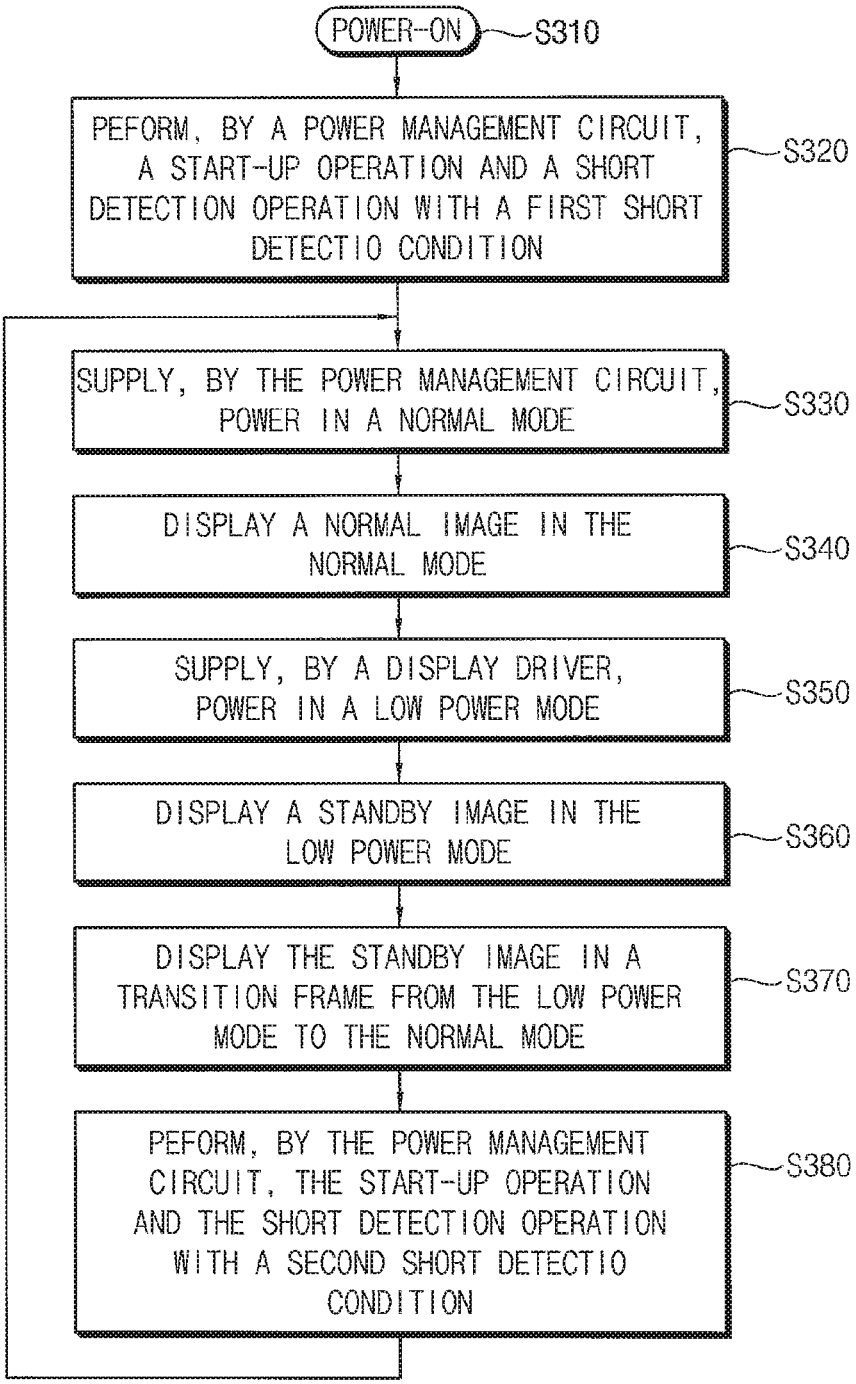
FIG. 9 is a flowchart of a method of operating a display device according to an exemplary embodiment.

FIG. 9 is a flowchart of a method of operating a display device according to exemplary embodiments.

Referring to FIGS. 1A, 1B, and 9, once a display device 100 is powered on (S310), a power management circuit 150 may perform a start-up operation that activates a first power supply voltage ELVDD and a second power supply voltage ELVSS and a short detection operation with a first short detection condition (S320). Once the start-up operation is completed, the display device 100 may operate in a normal mode.

In the normal mode, the power management circuit 150 may supply the first power supply voltage ELVDD and the second power supply voltage ELVSS to a display panel 110 (S330), a display driver 130 may provide a first image signal SIMG1 for a normal image 120 to the display panel 110 and the display panel 110 may display the normal image 120 based on the first image signal SIMG1 (S340). The display device 100 may transition to a low power mode in response to a mode control signal indicating the low power mode.

In the low power mode, the display driver 130 may supply a first standby power supply voltage U_ELVDD and a second standby power supply voltage U_ELVSS to the display panel 110 (S350), the display driver may provide a second image signal SIMG2 for a standby image 125 to the display panel 110, and the display panel 110 may display the standby image 125 based on the second image signal SIMG2 (S360). The display device 100 operating in the low power mode may perform a mode transition operation that transitions from the low power mode to the normal mode in at least one transition frame in response to the mode control signal indicating the normal mode.

In the transition frame from the low power mode to the normal mode, the display driver 130 may provide the second image signal SIMG2 for the standby image 125 to the display panel 110, and the display panel 110 may display the standby image 125 based on the second image signal SIMG2 (S370). Accordingly, the mode transition may not be perceived by a user, and a seamless mode transition may be performed.

Further, in the transition frame, the power management circuit 150 may the start-up operation and the short detection operation with a second short detection condition different from the first short detection condition (S380). For example, the first short detection condition may be that a panel current flowing through the display panel 110 is greater than a first reference current, and the second short detection condition may be that the panel current is greater than a second reference current that is greater by a driving current flowing through the display panel 110 for displaying the standby image than the first reference current. Accordingly, in the transition frame, the standby image 125 (e.g., an AOD image including at least one of a time image, a date image and a weather image) is displayed, and the power management circuit 150 may accurately perform the short detection operation using the second short detection condition although the driving current for displaying the standby image 125 flows through the display panel 110.

Figure 10:
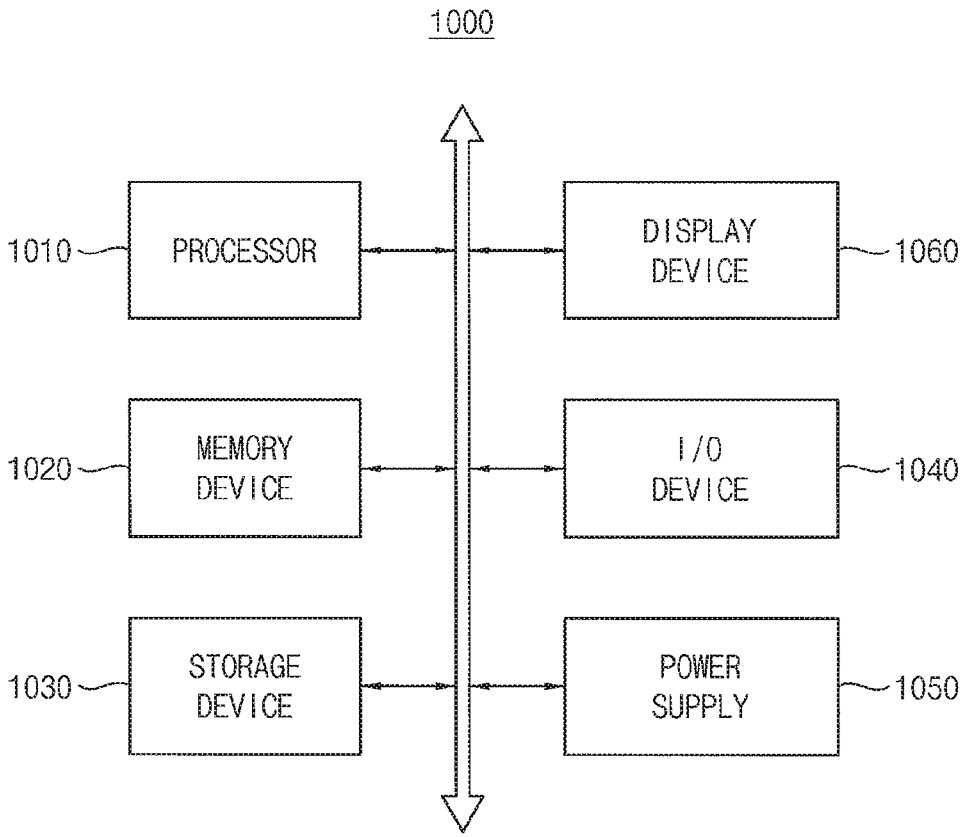
FIG. 10 is a block diagram illustrating an electronic device including a display device according to an exemplary embodiment.

FIG. 10 is a block diagram illustrating an electronic device including a display device according to exemplary embodiments.

Referring to FIG. 10, an electronic device 1000 may include a processor 1010, a memory device 1020, a storage device 1030, an input/output (I/O) device 1040, a power supply 1050 and a display device 1060. The electronic device 1000 may further include a plurality of ports for communicating a video card, a sound card, a memory card, a universal serial bus (USB) device, other electronic devices, etc.

The processor 1010 may perform various computing functions or tasks. In some exemplary embodiments, processor 1010 may be an application processor (AP), a central processing unit (CPU), a graphics processing unit (GPU), a micro processor, etc. The processor 1010 may be coupled to other components via an address bus, a control bus, a data bus, etc. Further, the processor 1010 may be coupled to an extended bus such as a peripheral component interconnection (PCI) bus.

The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAIVI) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 1030 may be a solid state drive device, a hard disk drive (HDD) device, a CD-ROM device, etc. The I/O device 1040 may be an input device such as a keyboard, a keypad, a mouse device, a touchpad, a touch-screen, a remote controller, etc, and an output device such as a printer, a speaker, etc. The power supply 1050 may provide power for operations of the electronic device 1000. The display device 1060 may be coupled to other components via the buses or other communication links.

In the display device 1060, in a transition frame from a low power mode to a normal mode, a display driver may provide an image signal for a standby image to a display panel, and a power management circuit may perform a short detection operation with a second short detection condition different from a first short detection condition at power-on of the display device 1060. Accordingly, the display device 1060 may perform a seamless mode transition by continuously displaying the standby image while transitioning from the low power mode to the normal mode, and may accurately perform the short detection operation with the second short detection condition while transitioning from the low power mode to the normal mode.

The inventive concepts may be applied to the display device 1060 and any electronic device 1000 including the display device 1060. For example, the inventive concepts may be applied to a smart phone, a wearable electronic device, a tablet computer, a mobile phone, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel configured to display a normal image in a normal mode and a standby image in a low power mode;

a power management circuit configured to:

perform a short detection operation with a first short detection condition during a start-up operation that activates a first power supply voltage and a second power supply voltage at power-on of the display device;

supply the first power supply voltage and the second power supply voltage to the display panel in the normal mode; and stop the supply of the first power supply voltage and the second power supply voltage in the low power mode; and a display driver configured to provide a first image signal for the normal image to the display panel in the normal mode, and to provide a second image signal for the standby image to the display panel in the low power mode, the display driver comprising a power block configured to supply a first standby power supply voltage and a second standby power supply voltage to the display panel in the low power mode, wherein, in a transition frame between the low power mode and the normal mode, the display driver is configured to provide the second image signal for the standby image to the display panel, and the power management circuit performs the short detection operation with a second short detection condition different from the first short detection condition.

2. The display device of claim 1, wherein the first short detection condition refers to a condition that a panel current flowing through the display panel is greater than a first reference current, and wherein the second short detection condition refers to a condition that the panel current is greater than a second reference current, the second reference current being greater than the first reference current.

3. The display device of claim 2, wherein the second reference current is greater than the first reference current by a driving current flowing through the display panel for displaying the standby image.

4. The display device of claim 1, wherein the display driver is configured to transfer a short detection condition setting pulse indicating the second short detection condition to the power management circuit to change a short detection condition of the power management circuit from the first short detection condition to the second short detection condition, in response to receiving a mode control signal to enter the low power mode, and wherein the display driver is configured to transfer the short detection condition setting pulse indicating the first short detection condition to the power management circuit to restore the short detection condition of the power management circuit to the first short detection condition, in response to receiving a mode control signal to transition from the low power mode to the normal mode.

5. The display device of claim 4, wherein the short detection condition setting pulse is transferred through a single wire between the display driver and the power management circuit.

6. The display device of claim 1, wherein the display panel is configured to display the standby image based on the second image signal provided from the display driver in the transition frame from the low power mode to the normal mode.

7. The display device of claim 1, wherein a line through which the first power supply voltage is supplied from the power management circuit to the display panel and a line through which the second power supply voltage is supplied from the power management circuit to the display panel are in high impedance states in the low power mode.

8. The display device of claim 1, wherein a line through which the first standby power supply voltage is supplied from the power block to the display panel and a line through which the second standby power supply voltage is supplied from the power block to the display panel are in high impedance states in the normal mode.

9. The display device of claim 1, wherein the power management circuit is configured to, during the start-up operation, activate the first power supply voltage, and then activate the second power supply voltage, wherein the power management circuit is configured to perform the short detection operation from a starting point of the activation of the first power supply voltage to a starting point of the activation of the second power supply voltage, and wherein the power management circuit is configured to:

determine whether the first short detection condition is satisfied according to a voltage level of the second power supply voltage during the short detection operation at the power-on; and determine whether the second short detection condition is satisfied according to the voltage level of the second power supply voltage during the short detection operation in the transition frame.

10. The display device of claim 1, wherein the power management circuit comprises:

a boosting converter configured to generate the first power supply voltage;

an inverting converter configured to generate the second power supply voltage;

a pull-down transistor connected to a line through which the second power supply voltage is supplied from the power management circuit to the display panel;

a pull-down resistor connected between the pull-down transistor and a ground voltage;

a comparator configured to compare the second power supply voltage with a short detection reference voltage; and a short control block configured to shut down the power management circuit in response to an output signal of the comparator.

11. The display device of claim 10, wherein the pull-down transistor is turned on to pull down the second power supply voltage in response to performing the short detection operation.

12. The display device of claim 10, wherein the short detection reference voltage has a first voltage level in response to performing the short detection operation with the first short detection condition, wherein the short detection reference voltage has a second voltage level in response to performing the short detection operation with the second short detection condition, and wherein the second voltage level is higher than the first voltage level.

13. The display device of claim 1, wherein the low power mode is an always-on display (AOD) mode.

14. The display device of claim 1, wherein the standby image is an always-on display (AOD) image comprising at least one of a time image, a date image and a weather image.

15. A method of operating a display device, the method comprising:

performing, by a power management circuit, a start-up operation that activates a first power supply voltage and a second power supply voltage and a short detection operation with a first short detection condition at power-on of the display device;

supplying, by the power management circuit, the first power supply voltage and the second power supply voltage to a display panel in a normal mode;

providing, by a display driver, a first image signal for a normal image to the display panel in the normal mode such that the display panel displays the normal image in the normal mode;

supplying, by the display driver, a first standby power supply voltage and a second standby power supply voltage to the display panel in a low power mode;

providing, by the display driver, a second image signal for a standby image to the display panel in the low power mode such that the display panel displays the standby image in the low power mode;

providing, by the display driver, the second image signal for the standby image to the display panel in a transition frame between the low power mode and the normal mode; and performing, by the power management circuit, the start-up operation and the short detection operation with a second short detection condition, the second short detection condition being different from the first short detection condition in the transition frame.

16. The method of claim 15, wherein the first short detection condition refers to a condition that a panel current flowing through the display panel is greater than a first reference current, and wherein the second short detection condition refers to a condition that the panel current is greater than a second reference current the second reference current being greater than the first reference current.

17. The method of claim 16, wherein the second reference current is greater than the first reference current by a driving current flowing through the display panel for displaying the standby image.

18. The method of claim 15, wherein the display panel displays the standby image based on the second image signal provided from the display driver in the transition frame from the low power mode to the normal mode.

19. The method of claim 15, wherein the low power mode is an always-on display (AOD) mode.

20. The method of claim 15, wherein the standby image is an always-on display (AOD) image comprising at least one of a time image, a date image and a weather image.

* * * * *